US007059007B2

(12) United States Patent
Ariznabarreta et al.

(10) Patent No.: US 7,059,007 B2
(45) Date of Patent: Jun. 13, 2006

(54) INDUSTRIAL BRUSH

(75) Inventors: Eduardo Zubiaurre Ariznabarreta, Elgeta (ES); Jose Manuel Zuazua Urruchua, San Sebastian (ES)

(73) Assignee: Jaz Zubiaurre, S.A., Eibar-Gipuzkoa (ES)

( * ) Notice: Subject to any disclaimer, the term of this patent is extended or adjusted under 35 U.S.C. 154(b) by 478 days.

(21) Appl. No.: 10/311,357

(22) PCT Filed: May 8, 2002

(86) PCT No.: PCT/ES02/00218

§ 371 (c)(1),
(2), (4) Date: Jul. 28, 2003

(87) PCT Pub. No.: WO02/090051

PCT Pub. Date: Nov. 14, 2002

(65) Prior Publication Data

US 2004/0006838 A1 Jan. 15, 2004

(30) Foreign Application Priority Data

May 10, 2001 (ES) ..... 200101076

(51) Int. Cl.
*A46B 13/00* (2006.01)
*A46B 9/08* (2006.01)

(52) U.S. Cl. ..... 15/180; 15/168; 15/87

(58) Field of Classification Search ..... 15/168–169, 15/180, 87, 399, 179, 198; 451/451–452, 451/455, 457

See application file for complete search history.

(56) References Cited

U.S. PATENT DOCUMENTS

| | | | | |
|---|---|---|---|---|
| 876,371 | A * | 1/1908 | Matchette et al. | 15/399 |
| 1,166,482 | A | 1/1916 | Reiche | 15/29 |
| 1,802,078 | A | 4/1931 | Exley | 15/198 |
| 3,010,135 | A * | 11/1961 | Pollnow, Jr. | 15/246 |
| 4,099,328 | A | 7/1978 | Schlemmer | 30/172 |
| 4,765,099 | A * | 8/1988 | Tanner | 451/359 |
| 5,588,176 | A * | 12/1996 | Sixsmith | 15/322 |

* cited by examiner

*Primary Examiner*—Richard Crispino
*Assistant Examiner*—Laura C Guidotti
(74) *Attorney, Agent, or Firm*—Jacobson Holman PLLC

(57) ABSTRACT

An industrial brush to remove material, of the type known as bowl headed, consisting of a rotating tool which is connected by means of an upper nut (3) to pins or bolts protruding from portable machines . This brush has a bowl shaped head (2) connected o the said nut (3) and a set of metal wire s or bristles (8) that come from the interior of the bowl shaped head and extend to form a hollow tubular space, either cylindrical or trunco-conical, which open out as a form of barrier when the brush rotates.

5 Claims, 2 Drawing Sheets

INDUSTRIAL BRUSH

This is a nationalization of PCT/ES02/00218, filed May 8, 2002 and published in Spanish.

PURPOSE OF THE INVENTION

This invention relates to an industrial brush of the type which have wire bristles and are used to remove material from work surfaces. Some of these bushes are of a specific shape based on a bowl-shaped head inside which the wire bristles are secured and protrude outwards, forming a hollow cylindrical or trunco-conical shape.

The bowl-shaped heads of these brushes have a nut at their base, by means of which they can be connected to a rotating tool responsible for providing the rotation to the brush so it can be used as a tool.

In units of this type, when rotation of the tool takes places, unwanted projections are caused both of pieces of the filament of the wire bristles and of the material which is continually removed by the brush. These projected particles are dangerous for the integrity of machine operators handling the tools, especially and particularly for their eyes.

As far as is known, there is no record of technical solutions aimed at safeguarding machine operators from this type of possible aggressions.

Therefore, the basic purpose of this invention is to provide an industrial brush that prevents any particle thrown out by the tool from causing injury to operators who are handling portable tools, and especially their eyes.

In order to put this objective into practice, the invention claims an industrial brush of the bowl head type, in which a set of thin plates or leaves are arranged and secured by one of their ends to the bowl, with their sides and free end extending towards the bristles of the brush.

These thin plates are made of a material provided with a certain flexibility, for instance a suitable plastic material, so that when the brush is in the rest position, they are situated over the bristles, covering the side surface formed by them.

When the brush is operated by the portable machine in question, the revolving speed causes the thin plates to be raised due to the centrifugal force, taking on the shape of a circular crown, contained, approximately, in a plane that will be perpendicular to the axis of the brush, thus forming a physical barrier that prevents the particles thrown out by the brush from reaching unprotected parts of the machine operator's body.

The ends of the thin plates can either be secured to the outer surface of the bowl shaped head, i.e. on its visible part, or otherwise in its interior, in the space provided between the inner side of the bowl shaped head and the concealed surface if the bristles.

In the same way, the ends of these thin plates could be connected to ring-shaped items, with the ring in turn being situated, according to its diameter, on the exterior or in the interior of the bowl shaped head. This possibility, although less economical that the previous one, offers the added advantage that the thin plates, together with the said ring, can be exchangeable or replaced by other if they should become unusable for any reason.

The thin plates can also be placed in the brush in the same brush manufacturing operation, for example by placing them at the same time as the wire bristles.

The plan view shape of the thin plates can be any that technique suggests—square, rectangular, trapezoidal, in the shape of a circular sector, etc., with the most appropriate being adopted in each case.

The thin plates can overlap each other in the folded position, so that when they are extended, in their working position, they occupy the whole of the circular crown shape that they establish.

The thin plates might, on the other hand, not be overlapping each other, but providing gaps when the brush is n operation, a factor that does not interfere in the effectiveness of the protective screen that they form, because the revolutions at which these machines work prevents any particles from passing through.

All these and other details of the invention can be seen on the accompanying sheets of drawings, on which the following are represented:

Figure 1:
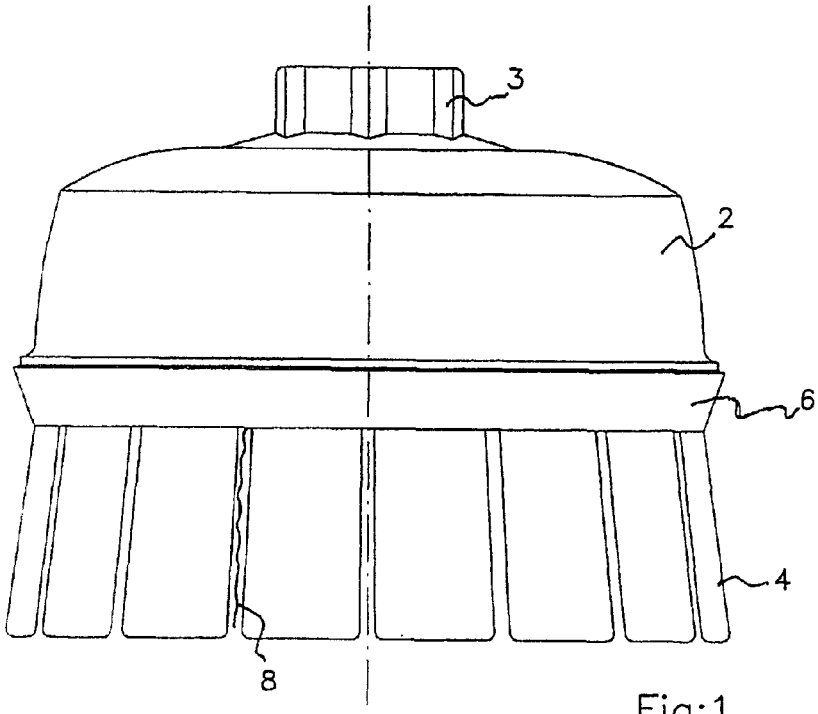
FIG. 1 is a symmetric elevation view of a brush, in accordance with one solution of the invention, shown in the rest position.

Looking now at FIG. 1, we can observe the brush (1) with the bowl shaped head (2), from inside which the wire bristles (8) start and protrude out through the lower area (6) of the said bowl shaped head.

The bowl shaped head has the upper nut (3) for its inter-connection with the rotating machine responsible for providing the rotation movement to the brush (1) The thin plates (4) come from the bowl shaped head (2, 6) and in this rest position, they are arranged over the bristles (8), as illustrated.

Figure 2:
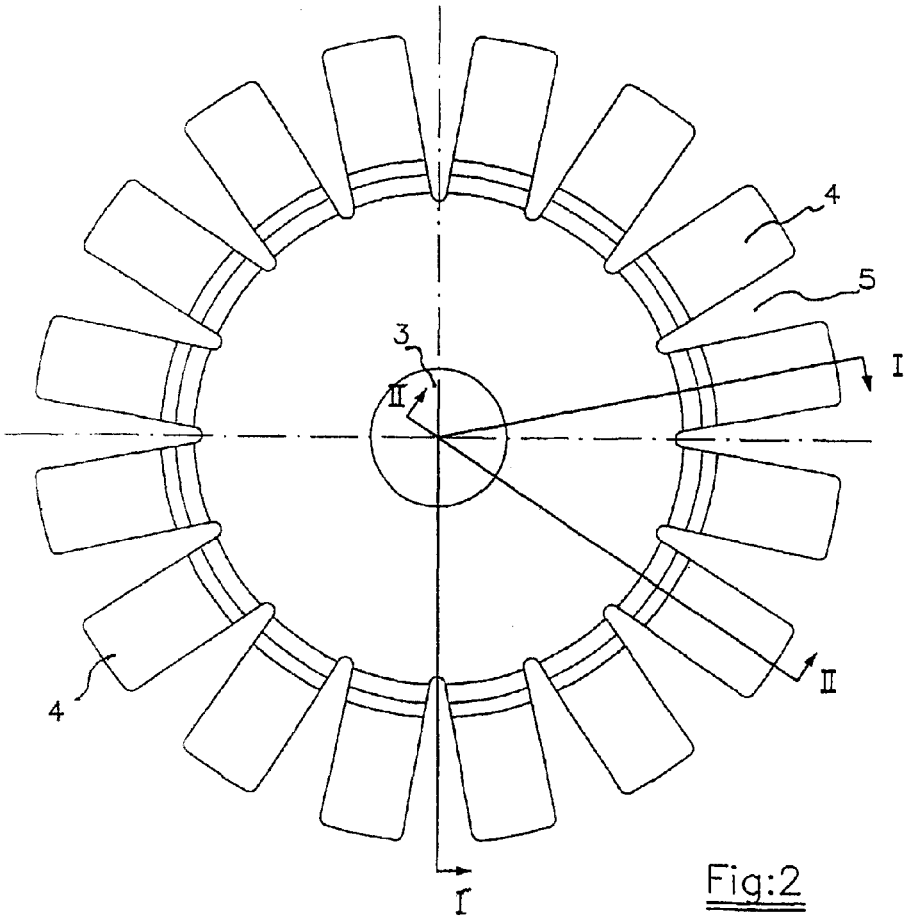
FIG. 2 is a plan view of the brush in accordance with the invention, shown in the operating position.

When the brush turns, FIG. 2, the flexibility that the thin plates (4) are provided with makes them take the position shown, for example, due to the centrifugal force. In the case shown, as a result of the plan shape of the thin plates, some gaps (5) are created between each two plates, although these gaps do not mean any diminishing of the formation of the barrier, due to the high revolutions at which these kind of brushes rotate, which makes it impossible for particles to pass through these gaps.

Figure 3:
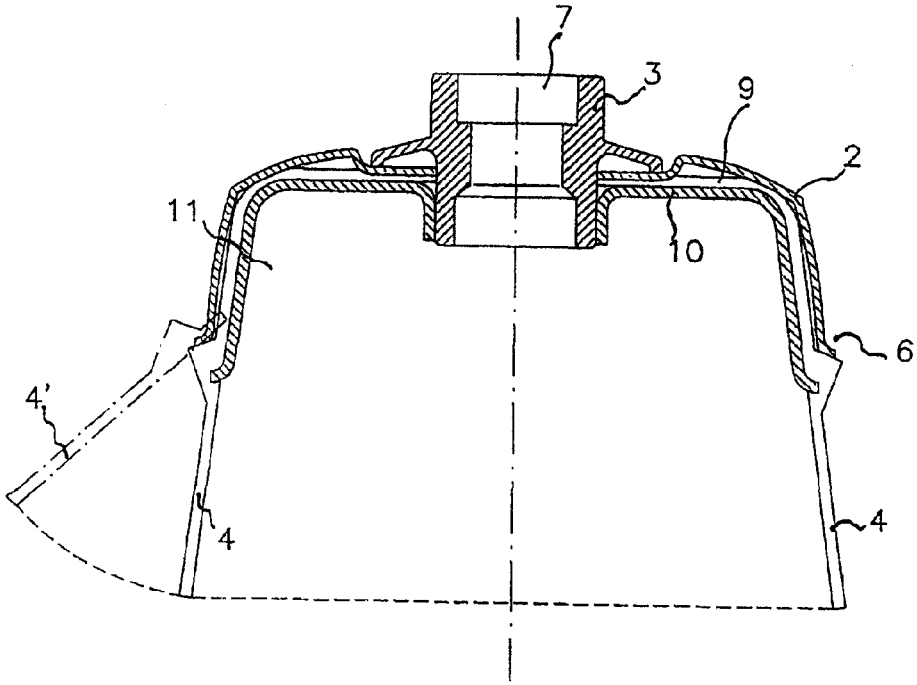
FIG. 3 is an elevation view of the brush, shown as a cross section along the line I—I in FIG. 2.
Figure 4:
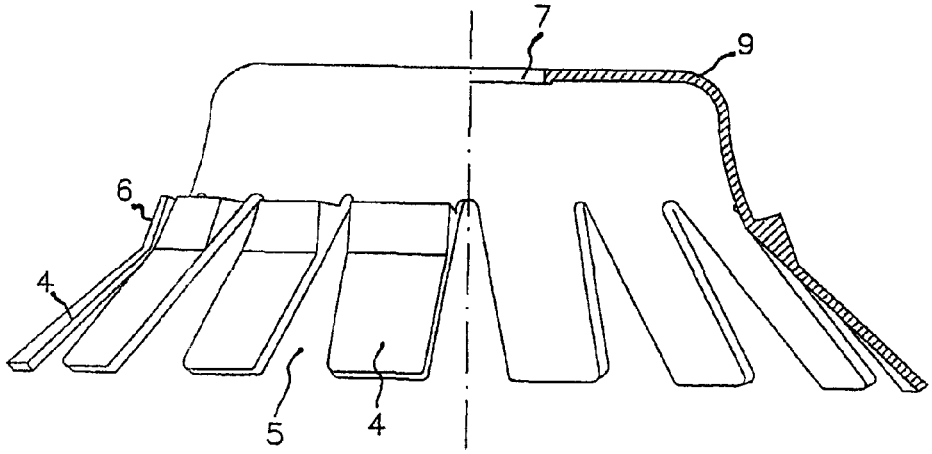
FIG. 4 is an elevation view of the brush, shown as a cross section along the line II—II in FIG. 2.

In FIGS. 3 and 4 we can observe the purpose of the invention more clearly, with the thin plates (4) in their folded position in FIG. 3, and in their open position when turning (M) of the brush takes place by means of the application in the hole (7) in the nut (3) of the appropriate portable tool.

The thin plates (4) preferably form part of a body or casing (9) connected between the outer (2) and inner (10) casings of the brush itself, as can be observed in FIG. 3.

The inner space (11) is where the wire bristles (8) are received and suitably fixed to the inner casing (10) in a known manner.

The invention claimed is:

1. Industrial brush, comprising of a bowl shaped head with a central hole in order to receive a nut that enables securing of the brush to a drive machine that it is connected to, which has a set of steel wire bristles arranged below the bowl shaped head and appropriately secured to the interior of the body of the brush, with these bristles usually being established in a cylindrical or trunco-conical shape in their rest position, and opening outwards slightly when the brush is in movement, in its working position, including a set of flexible thin plates each having at least one end being secured to the bowl shaped head, with these plates extending towards the exterior, outside and over the bristles, and a occupying the whole of a side surface formed by the said bristles in a rest position of the brush, in that these thin plates open out and rise when the brush is in movement, forming a physical barrier that protects the machine operator not only from fragments of the brush bristle filaments but also from the material removed from the work piece by the brush.

2. Industrial brush, in accordance with claim 1, wherein the position of the thin plates, in their open condition, take the approximate shape of a continuous circular crown.

3. Industrial brush, in accordance with claim 1, wherein the position of the thin plates, in their open condition, take the approximate shape of a discontinuous circular crown.

4. Industrial brush, in accordance with claim 1, in which the thin plates are trapezoidal in shape.

5. Industrial brush, in accordance with claim 1, wherein the thin plates form the free ends of a body arranged between the outer body of the brush and the inner body.

* * * * *